US005271386A

United States Patent [19]

Thompson

[11] Patent Number: 5,271,386

[45] **Date of Patent: * Dec. 21, 1993**

[54] MASSAGE TABLE

[76] Inventor: Terry D. Thompson, 2205 W. Eighth, Coffeyville, Kans. 67337

[ * ] Notice: The portion of the term of this patent subsequent to May 21, 2008 has been disclaimed.

[21] Appl. No.: 348,568

[22] Filed: May 8, 1989

[51] Int. Cl.[5] ..... A61H 15/00

[52] U.S. Cl. ..... 128/52; 128/57; 128/51; 128/33

[58] Field of Search ..... 128/57.51, 52.33

[56] References Cited

U.S. PATENT DOCUMENTS

| | | | |
|---|---|---|---|
| 3,279,462 | 10/1966 | Niquet | 128/57 |
| 3,289,673 | 12/1966 | Russo | 128/57 |
| 3,882,856 | 5/1975 | Heuser et al. | 128/52 |
| 4,190,043 | 2/1980 | Thompson | 128/52 |
| 4,198,962 | 4/1980 | McCauley | 128/33 |
| 4,373,516 | 2/1983 | Masuda et al. | 128/57 |
| 4,425,910 | 1/1984 | Meiller | 128/52 |
| 4,506,660 | 3/1985 | Curran | 128/57 |

*Primary Examiner*—Edgar S. Burr
*Assistant Examiner*—Lisa E. Malvaso
*Attorney, Agent, or Firm*—William S. Dorman

[57] ABSTRACT

A massage table is disclosed which has a flat stationary top covered with flexible material. A carriage is mounted for longitudinal movement beneath the top. The carriage has a first freely rotatable roller mounted transversely on the carriage for contacting the legs of a patient lying on the top in an area between the knee and the ankle of the patient, a second transverse roller mounted on the carriage parallel to the first roller for contacting the patient in the area of the thighs and a third transverse roller mounted on the carriage parallel to the first and second rollers for contacting the patient in the area of the back and shoulders. A fourth roller mechanism is mounted in the table to contact the patient in the neck area. The fourth roller mechanism includes a rotatable triangular carriage, a set of transverse rollers mounted on each apex of the triangular carriage, with each set of transverse rollers being formed by a pair of hemispherical roller portions whose curved portions face each other.

3 Claims, 5 Drawing Sheets

MASSAGE TABLE

BACKGROUND OF THE INVENTION

1. Field of the Invention

The present invention relates to a massage table. More particularly, this invention relates to a massage table which includes improved design in mounting of the massage rollers.

2. The Prior Art

In my prior U.S. Pat. No. 4,190,043, issued Feb. 26, 1980, on "Massage Table Drive System", a massage table is shown having a flat lounge top which is moved back and forth over a massage mechanism. The message mechanism includes a pair of parallel triangular plates, across the corners of which are grooved massage rollers which are adapted to contact the patient in an area extending from high between the shoulders to the lumber region. The triangular plates are rotatable so that the grooved rollers move in an arc against the upper body portion of the patient.

A patent search was conducted on the present invention and the following additional U.S. patents were uncovered in the search.

| U.S. Pat. No. | Patentee | Date |
|---|---|---|
| 3,279.462 | S. Niquet | 10/18/66 |
| 3,289,673 | B. J. Russo | 12/06/66 |
| 3,882,856 | Heuser et al | 5/13/75 |
| 4,198,962 | McCauley | 4/22/80 |
| 4,373,516 | Masuda et al | 2/15/83 |
| 4,425,910 | Meiller | 1/17/84 |
| 4,506,660 | Curran | 3/26/85 |

Masuda et al, U.S. Pat. No. 4,373,516, has spring loaded rollers mounted on a solid axle.

Heuser et al, U.S. Pat. No. 3,882,856, shows solid rollers with grooves for the spinous process for the spine.

The remaining patents require no comment.

SUMMARY OF THE INVENTION

A massage table having a flat stationary lounge top which is covered with Naugahyde or other suitable flexible covering. The top is provided with a frame having cross members which extend across the table transversely in those areas where there is no roller contact. Between the cross members, however, there are open areas or cut-outs such that the rollers bear against the Naugahyde so as to act on the body of the patient who is lying on the massage table. There are three sets of parallel rollers mounted on a moveable carriage positioned in the table beneath the top. One of these three rollers will contact the legs of the patient between the knee and the ankle, the second roller will contact the patient in the area of the thighs and the third roller will contact the patient in the area of the back and the shoulders. As the carriage moves, these three rollers will massage the patient in the areas described above.

A fourth roller mechanism (not mounted on the slideable carriage) is adapted to contact the patient in the neck area. This fourth roller mechanism actually consists of three sets of rollers which are mounted on the apices of a triangular carriage which is rotatable. Each of these three rollers consists of a pair of hemispherical roller portions whose curved portions face each other. Each roller portion is transversely moveable with respect to its opposite roller portion. Each roller portion is mounted on a shaft which is carried by the triangular carriage. A spring is mounted on each roller shaft between each roller portion and a bushing on the triangular carriage. If sufficient pressure is exerted on the roller portions, they can separate from each other against the action of the springs.

The present invention also includes an adjustment feature for the mounting of the rollers to the reciprocating carriage. Each of the rollers which is mounted on the reciprocating carriage is received on a shaft which extends across the full width of the carriage. Each end of the roller shaft is received in a cap or fitting and a spring is received in the cap adjacent the end of the shaft. Each cap is provided with a cylindrical extension on the side opposite from the shaft. The cylindrical extension is received in a washer which is welded to the top of a machine screw. The machine screw is threadedly received in a nut which is welded to the frame of the carriage. Any roller (on the moveable carriage) can be simply removed or replaced by moving the caps towards each other against the action of the springs. When the caps are no longer in engagement with the washers, the machine screws can be turned so as to lower or raise the axis of rotation for the roller.

DETAILED DESCRIPTION OF THE PREFERRED EMBODIMENTS

Figures 1, 2:
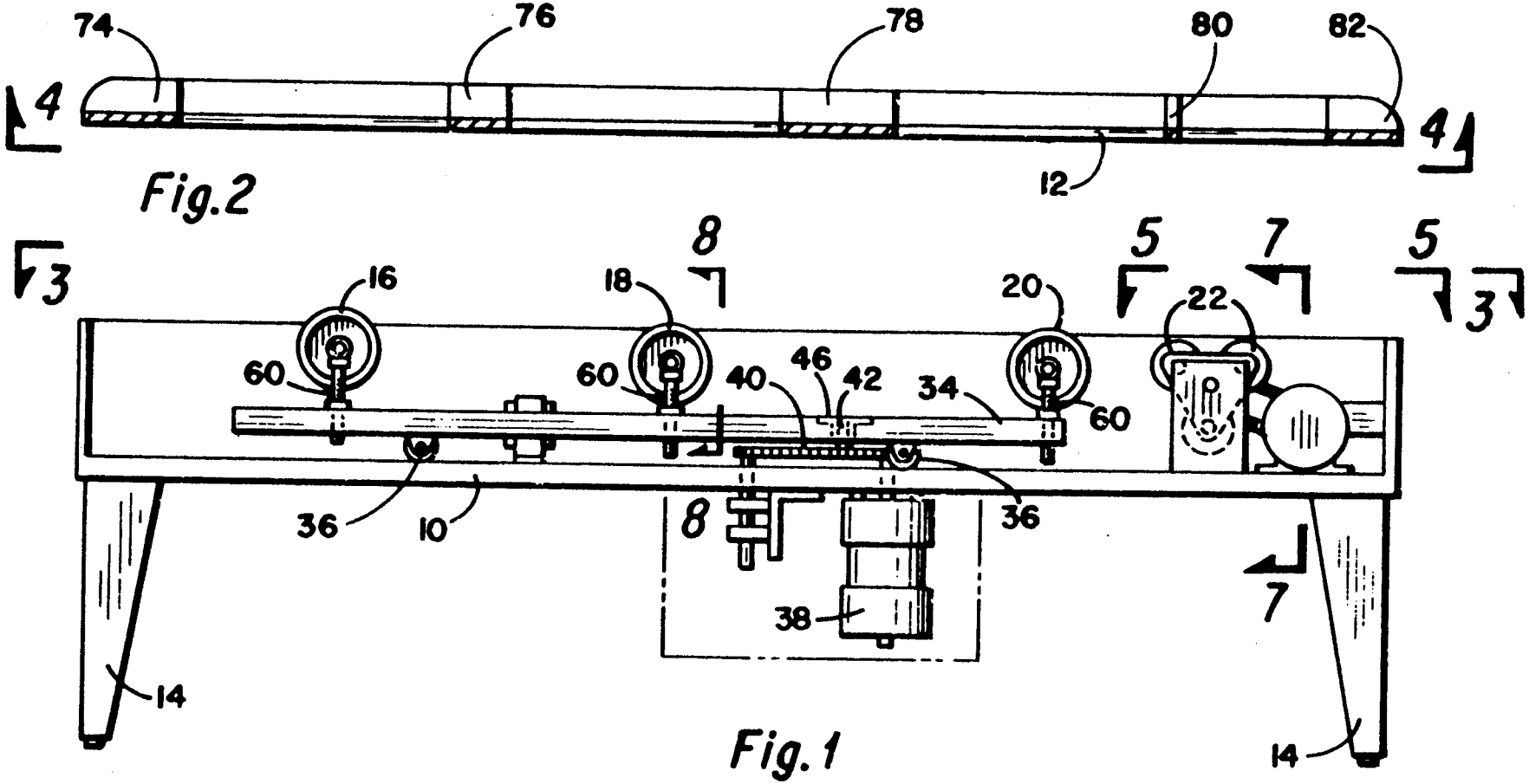
FIG. 1 is a side elevation of a massage table in accordance with the present invention, but with the front edge removed to show the various rollers.
FIG. 2 is a longitudinal sectional view of the cover for the table of FIG. 1.

Referring to the drawings in detail, FIGS. 1 to 4 show a message table 10 mounted at the upper ends of vertical supports 14. A top piece 12, preferably covered with Naugahyde is adapted to overlie the top of the table 10. The table is further provided with a solid roller 16 which will support the legs of the patient between the knee and the ankle; split rollers 18 which will support the patient in the area of the thighs; split rollers 20 which will support the patient in the area of the back and shoulders and a plurality of hemispherical rollers 22 which will support the neck of the patient.

Rollers 22 of the present invention are similar in function to the rollers 42 of my prior U.S. Pat. No. 4,190,043, in that there are three sets of rollers 22 triangularly mounted on a triangular carriage 24 which is adapted to rotate by means of a motor 26 and a chain 28. See FIGS. 3, 5, 6 and 7. The details of the chain drive are essentially the same as those of the patent. Each roller portion 22 is hemispherical in shape and is transversely movable with respect to its opposite roller portion 22. Each roller portion 22 is mounted on a shaft 30. A spring 32 is mounted on the shaft 30 between each roller portion 22 and a bushing 31 which is attached to the triangular carriage 24. If sufficient pressure is exerted on the roller portions 22, they can separate from each other against the action of the springs 32.

Rollers 16, 18 and 20 are supported on a carriage 34 which can move back and forth inside the table 10 by means of rollers 36 which ride on an internal track within the table. A motor 38 drives a belt or chain 40 which has a pin 42 extending upwardly from the chain. The pin 42 is received in a slot 44 and a cross member 46. As the chain 40 rotates, the action of the pin 42 in the slot 44 requires the carriage 44 to move to the left and to the right in relation to FIG. 1. A third motor 48 is mounted within the table to impart vibrations to the table in a conventional manner.

The rollers 18 and 20 are split in that there is a recess 18 R between the two sections of roller 18 and recess 20 R between the two sections of roller 20; this will allow the spine to protrude into the areas between the split rollers. The rollers 18 and 20, however, do not separate as in the case of rollers 22.

Figure 9:
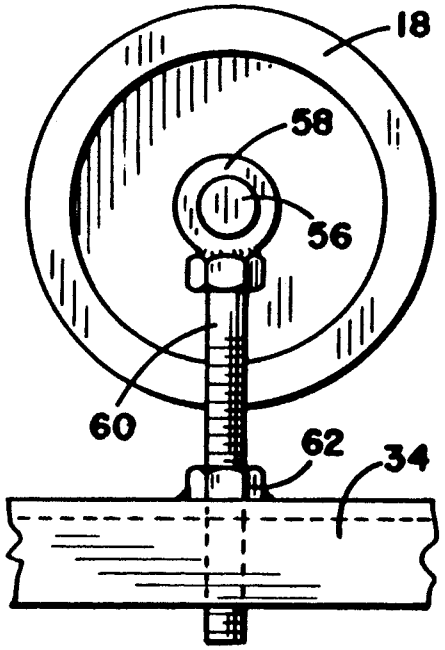
FIG. 9 is a partial front elevation on a slightly enlarged scale, taken along line 9—9 of FIG. 8 and showing details of the end support for one of the central rollers.
Figure 7:
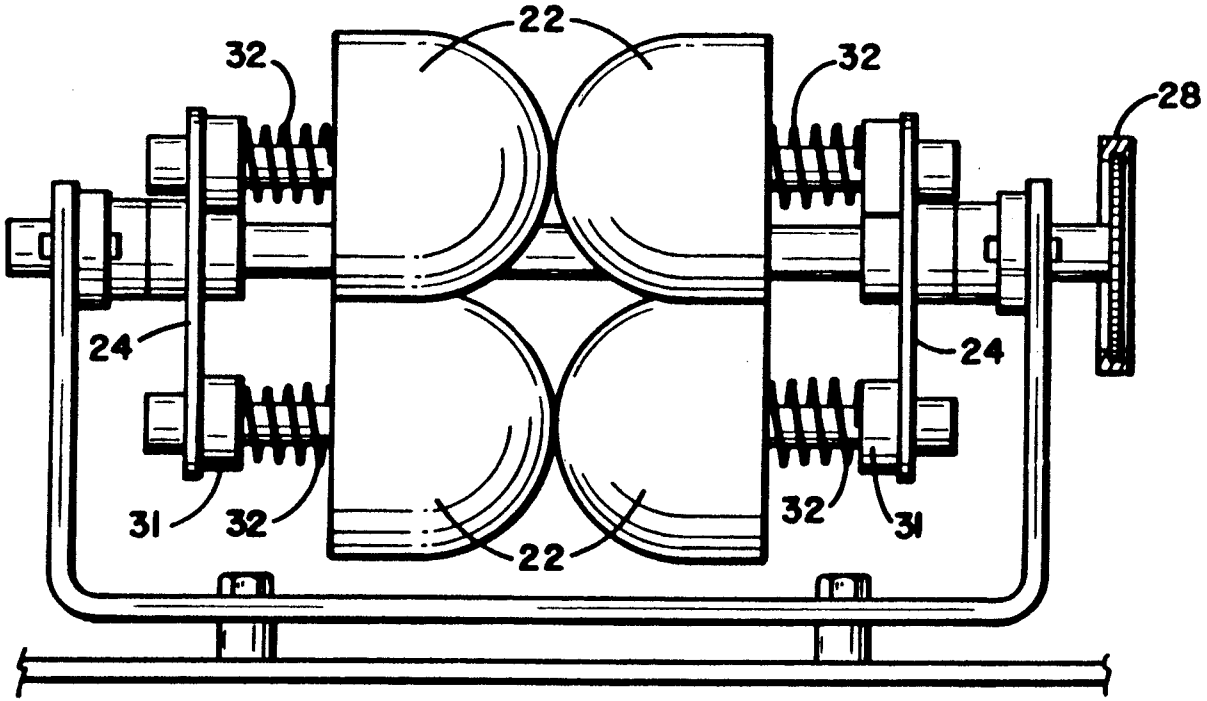
FIG. 7 is a transverse view taken along line 7—7 of FIG. 1.
Figure 8:
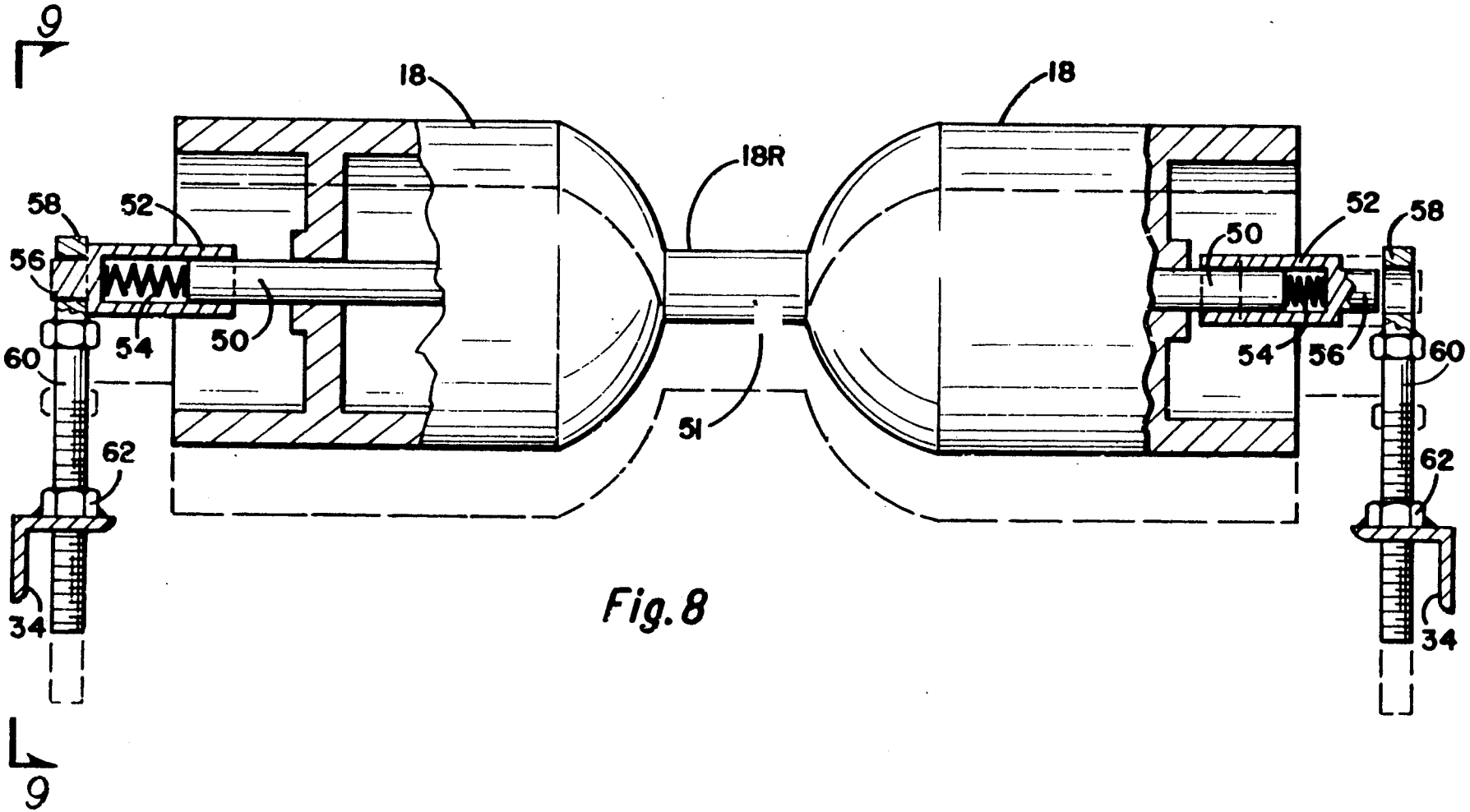
FIG. 8 is a transverse sectional view taken along line 8—8 of FIG. 1 and showing on an enlarged scale, details of one of the intermediate rollers.

An adjustment feature for the rollers 16, 18 and 20 is shown in FIGS. 1, 8 and 9. FIGS. 8 and 9 illustrate this adjustment more clearly in relation to the roller assembly 18, it being understood that this adjustment applies also to rollers 16 and 20. Roller 18 is mounted for free rotation on a shaft 50 which extends through both sections of roller 18. The two sections of roller 18 are separated by a collar 51. Again, these roller sections 18 do not separate from each other. Each end of the shaft is received in a cap or fitting 52 which is best illustrated in FIG. 8. A spring 54 is received in the shaft 52 and bears against the end of the shaft 50 and the opposite internal end of the cap 52. Each cap 52 is provided with a cylindrical extension 56 which is received in a washer 58 that is welded to the top of a machine screw 60. The machine screw 60 is threadedly received in nut 62 which is welded to the frame of the carriage 34. If it were desired to raise or lower the roller assembly 18, one would merely pull back on the cap 52 so as to compress the spring 54, thereby removing the cylindrical extension 56 from the washer 58, as shown on the right side of FIG. 8. At this time, the machine screw 60 can be turned to raise or lower the washer 58. When the washer 58 is at the proper elevation, the cap 52 is released so that the cylindrical extension 56 is again engaged by the washer 58. This adjustment is provided at the ends of the rollers 16 and 20 as well. This adjustment can be used also to replace one roller with a different type or shape of roller.

Figure 4:
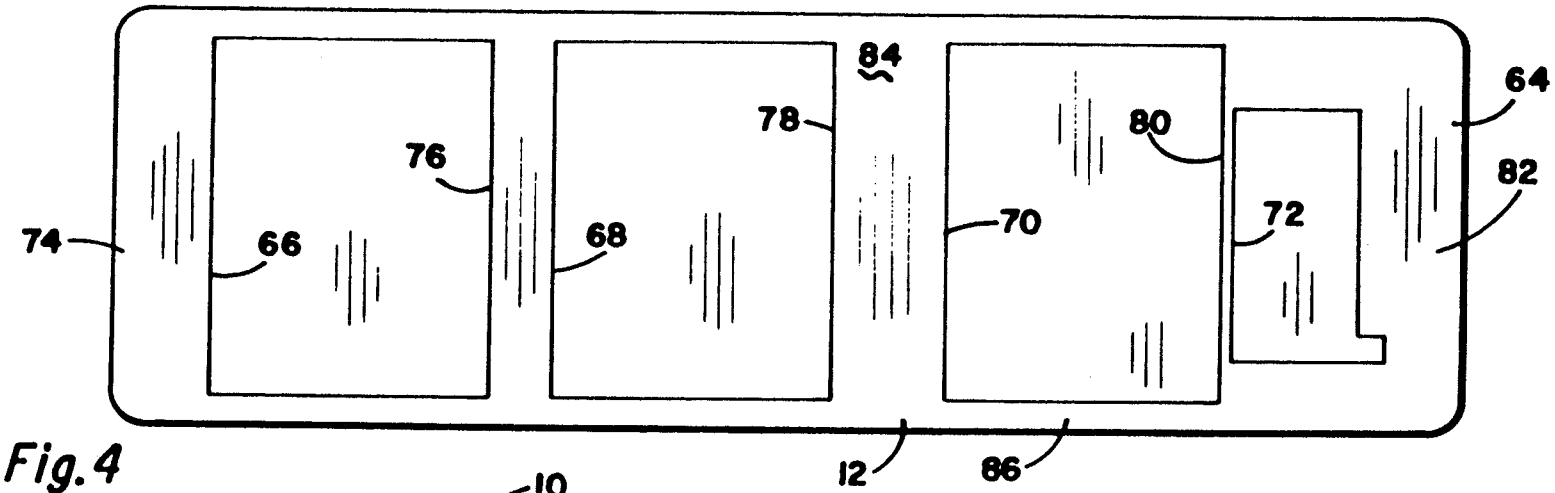
FIG. 4 is a bottom view of the cover looking along line 4—4 of FIG. 2.
Figure 3:
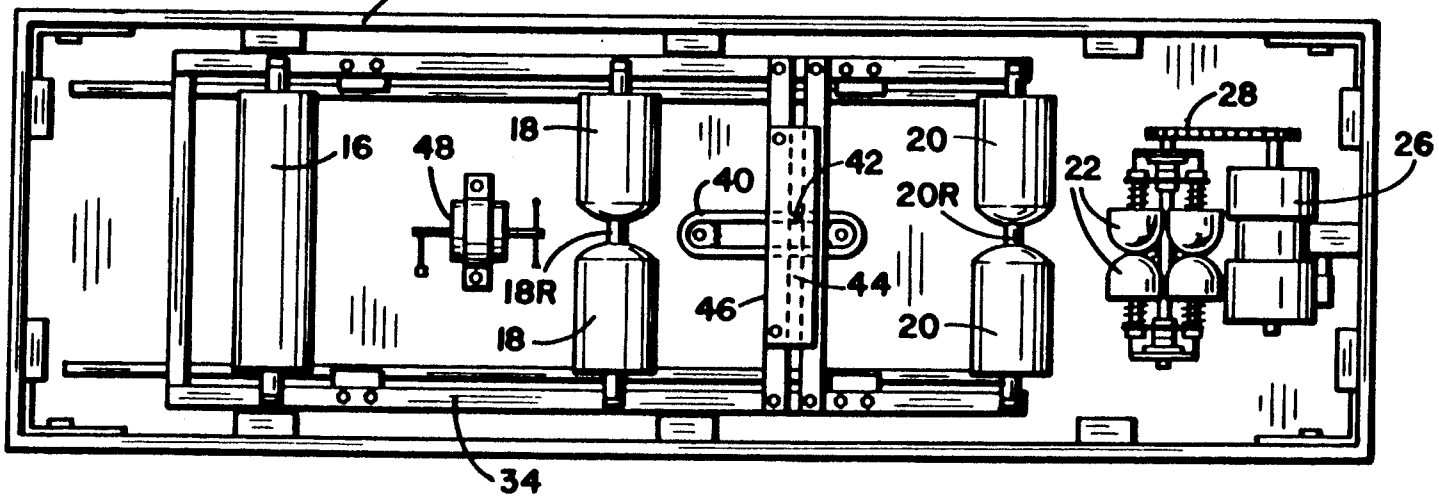
FIG. 3 is a plan view of the table shown in FIG. 1 as looking along line 3—3 of FIG. 1.
Figure 6:
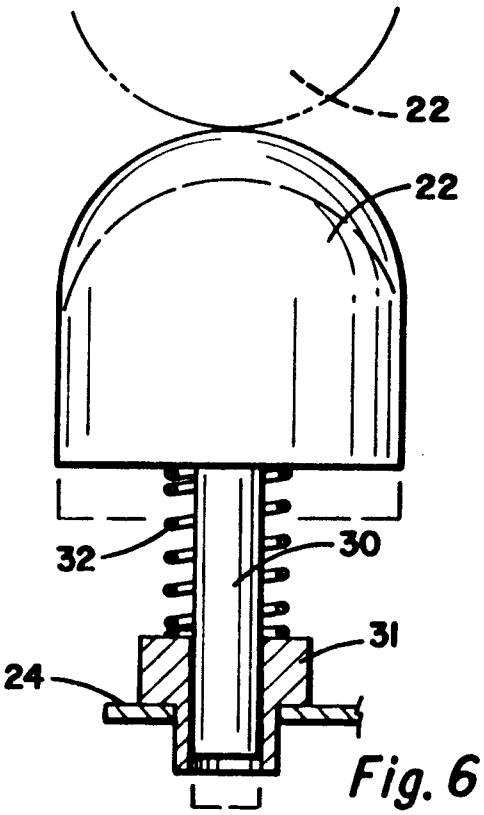
FIG. 6 is a partial sectional view, on a slightly enlarged scale of one of the neck roller sub-assemblies shown in FIG. 5.
Figure 5:
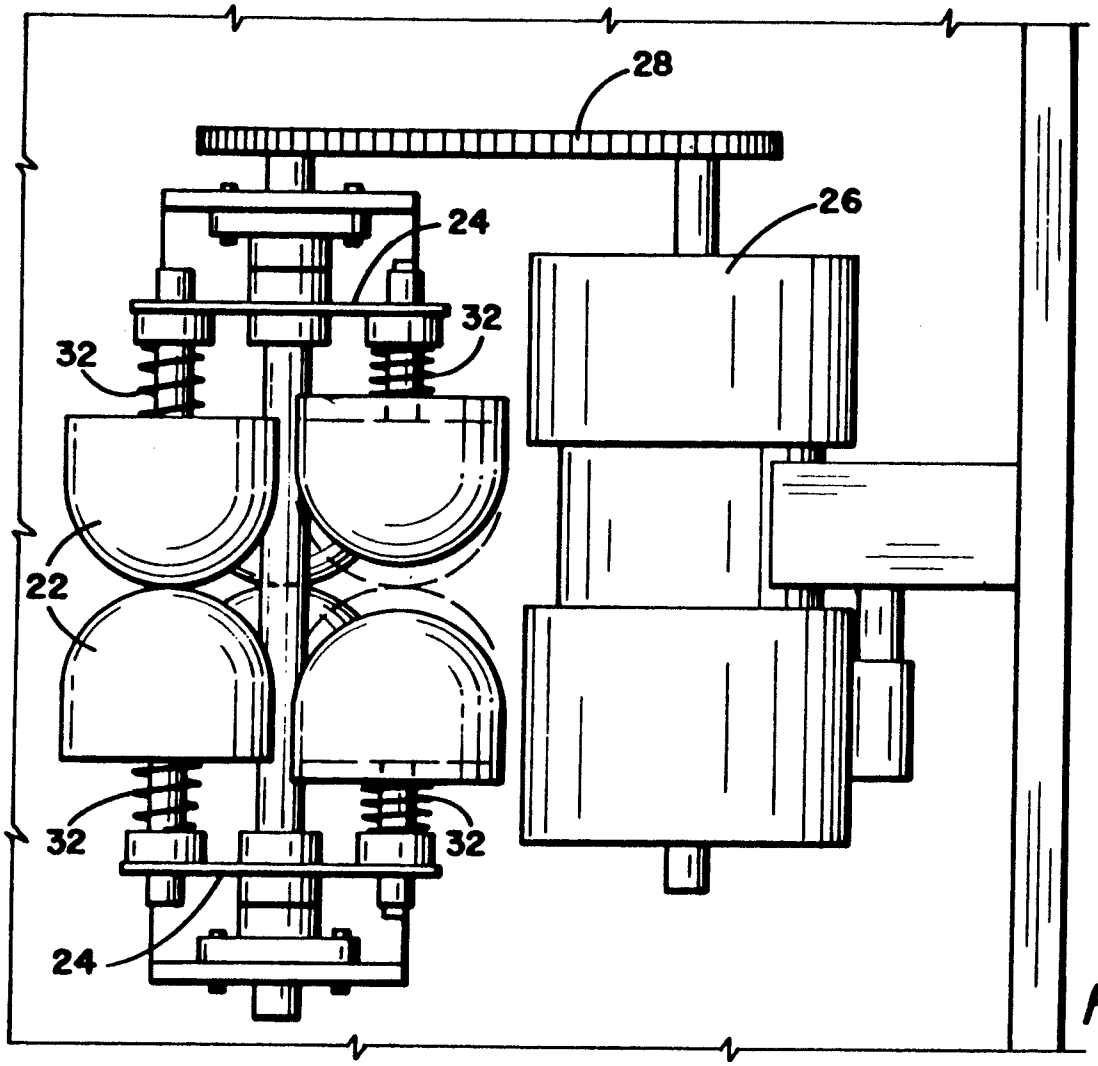
FIG. 5 is a partial plan view taken along line 5—5 of FIG. 1 showing details of the neck roller on an enlarged scale.

Turning now in consideration of FIGS. 2 and 4, the top 12 is provided with a lower flat frame 64 which has cut out portions 66, 68, 70 and 72 from between corss members 74, 76, 78, 80 and 82, which extend across the full width of the top 12. Longitudinal portions 84 and 86 are sufficiently wide so that, even with the cut-outs, the frame 64 has sufficient strength to support a patient on the top 12. Cut-out 66 is located above the roller 16 and will contact the Naugahyde cover on the top 12 immediately between the legs of the patient between the knee and the ankle as previously indicated. The cut-out portion 68 is similarly disposed over the split rollers 18 whereas cut-out portion 70 is disposed over the split rollers 20. Cut-out portion 72 is disposed over the rotating hemispherical rollers 22.

The following are advantages of the present invention:

1. The shape of the neck massage rollers 22 is half-spherical.
2. The neck massage mechanism is spring loaded to give variable resistance to the neck muscles.
3. The half-spherical shape of the neck massage mechanism is designed for the spinous process of the cervical vertebrae.
4. The neck massage mechanism is made in a triangular configuration which allows continual massage to take place (as the mechanism turns and completes a lift cycle, the next spherical contacts are beginning the lift cycle).
5. A massage carriage mounted for longitudinal reciprocation within the table portion has three wide massage rollers which are all adjustable in height (for stronger massage of the back and legs if desired).
6. The three roller massage carriage massages:
   rollers 16—the back of the calf only;
   rollers 18—the back of the thigh only; and
   rollers 20—the back of the shoulders upper, mid, lower back only.
7. The three massage rollers can be easily removed by using spring loaded ends on both ends of the carriage shaft which allows for vertical adjustment of the rollers and for interchange of roller shapes for different massage sensations.

Whereas the present invention has been described in particular relation to the drawings attached hereto, it should be understood that other and further modifications, apart from those shown or suggested herein, may be made within the spirit and scope of this invention.

What is claimed is:

1. An elongated massage table having a flat stationary lounge top covered with a suitable flexible material, a carriage mounted for longitudinal movement beneath the top, a first freely rotatable roller mounted transversely on the carriage for contacting the legs of a patient lying on the top in an area between the knee and the ankle of the patient, a second transverse roller mounted on the carriage parallel to the first roller for contacting the patient in the area of the thighs, a third transverse roller mounted on the carriage and parallel to the first and second rollers for contacting the patient in the area of the back and shoulders, means for reciprocating the carriage longitudinally, a fourth roller mechanism mounted in the table and adapted to contact the patient in the neck area, the fourth roller mechanism comprising a pair of spaced triangular plates constituting a rotatable triangular carriage, a set of transverse rollers mounted on each apex of the triangular carriage, each of the rollers mounted on the triangular carriage consisting of a pair of hemispherical roller portions whose curved portions face each other, each roller portion being mounted on a shaft carried by the triangular carriage, a spring mounted on each roller shaft between each roller portion and a bushing on the triangular carriage whereby the roller portions of each roller are urged toward each other, and means for rotating the triangular carriage.

2. A message table as set forth in claim 1 wherein the top is provided with a frame having cross members extending transversely across the table between the areas of roller contact with the patient, the frame providing open areas between the cross members such that all of the rollers will message the patient in the areas described above as the moveable carriage moves longitudinally and as the triangular carriage is rotated.

3. A massage table as set forth in claim 1 wherein each of the rollers which is mounted on the reciprocating carriage is received on a shaft which extends across the full width of the carriage, each end of the roller shaft being received in a cap, a spring received in the cap adjacent the end of the shaft, each cap being provided with a cylindrical extension on the side opposite from the shaft, the cylindrical extension being received in a washer which is welded to the top of a machine screw, the machine screw being threadedly received in a nut which is welded to the frame of the carriage, whereby any roller on the moveable carriage can be simply removed by moving the caps towards each other against the action of the springs.

* * * * *